US009284491B2

(12) United States Patent
Kim

(10) Patent No.: US 9,284,491 B2
(45) Date of Patent: Mar. 15, 2016

(54) DEVICE FOR A DIRECTED INTRODUCTION OF PRIMARY COMBUSTION AIR INTO THE GAS SPACE OF A COKE BATTERY

(75) Inventor: Ronald Kim, Essen (DE)

(73) Assignee: THYSSENKRUPP INDUSTRIAL SOLUTIONS AG, Essen (DE)

( * ) Notice: Subject to any disclaimer, the term of this patent is extended or adjusted under 35 U.S.C. 154(b) by 980 days.

(21) Appl. No.: 12/736,855

(22) PCT Filed: Apr. 28, 2009

(86) PCT No.: PCT/EP2009/003077

§ 371 (c)(1),
(2), (4) Date: Feb. 4, 2011

(87) PCT Pub. No.: WO2009/143948

PCT Pub. Date: Dec. 3, 2009

(65) Prior Publication Data

US 2011/0120852 A1 May 26, 2011

(30) Foreign Application Priority Data

May 27, 2008 (DE) ..... 10 2008 025 437

(51) Int. Cl.
*C10B 15/02* (2006.01)
*F27D 7/02* (2006.01)

(52) U.S. Cl.
CPC .. *C10B 15/02* (2013.01); *F27D 7/02* (2013.01)

(58) Field of Classification Search
CPC ..... C10B 15/02; F27D 7/02
USPC ..... 202/135, 145, 151, 101, 93, 211, 212; 201/15, 27
See application file for complete search history.

(56) References Cited

U.S. PATENT DOCUMENTS

| | | | | |
|---|---|---|---|---|
| 523,602 | A * | 7/1894 | Christie | 202/93 |
| 1,058,550 | A * | 4/1913 | Shrewsbury | 202/244 |
| 2009/0152092 | A1 | 6/2009 | Kim et al. | |
| 2010/0300867 | A1 | 12/2010 | Kim et al. | |

FOREIGN PATENT DOCUMENTS

| | | | |
|---|---|---|---|
| CN | 1255528 | A | 6/2000 |
| CN | 2435394 | Y | 6/2001 |
| DE | 81916 | C | 7/1894 |
| DE | 10 2007 042502 | A1 | 3/2009 |
| WO | WO 2006/103043 | A1 | 10/2006 |
| WO | WO 2006/128612 | A1 | 12/2006 |

OTHER PUBLICATIONS

Machine translation of CN 1255528 (Jun. 2000).*
Machine translation of CN 2435394 (Jun. 2001).*

* cited by examiner

*Primary Examiner* — Jill Warden
*Assistant Examiner* — Joye L Woodard
(74) *Attorney, Agent, or Firm* — Lathrop & Gage LLP

(57) ABSTRACT

A device for a directed gas routing of primary air into a coke chamber oven is disclosed. The primary air is conducted through the coke chamber top into the gas space of a coke oven battery and is laterally deflected as it enters into the gas space of the coke chamber. Also disclosed is a method for lateral deflection of primary air as it enters into the coke oven chamber, thus improving the distribution of the primary air in the coke oven chamber.

10 Claims, 8 Drawing Sheets

DEVICE FOR A DIRECTED INTRODUCTION OF PRIMARY COMBUSTION AIR INTO THE GAS SPACE OF A COKE BATTERY

BACKGROUND

The present invention relates to a device for the supply of primary combustion air into the coking chamber of a coke oven of the "Non-Recovery" or "Heat-Recovery" type, with primary combustion air being introduced through one or several entry ports in the coke oven top, and with the entry port(s) being equipped with devices through which primary air in the gas space can be better distributed over the coke cake. The invention also relates to a method for the operation of a coke oven or coke oven battery, with primary air for coal carbonization being conducted through one or several entry ports in the top of each oven chamber above the oven into a gas-filled space located above the coke cake where partial combustion of the coking gas with primary air takes place, and wherein the primary air streams to the coke cake through the devices conducting the gas stream at an angle of less than 90°.

The production of coke from coal or carbonaceous materials is frequently carried-out in coke ovens of the "Non-Recovery" or "Heat-Recovery" type. With coke ovens of the "Non-Recovery" or "Heat-Recovery" type, coal is heated to a high temperature, whilst the gas thus generated is burnt with an under-stoichiometrical amount of so-called primary air. In general, combustion with primary air is incomplete and occurs in a gas-filled space above the coke cake. From this gas-filled space, incompletely burnt coking gas is conducted in so-called "downcomer" channels into secondary air soles underneath the coking chamber, where so-called secondary streams in and where the incompletely burnt coking gas is completely burnt. A more homogeneous heat distribution of the entire coke cake is achieved in this manner. With the "Heat-Recovery" type, heat from combustion is additionally utilized to generate energy.

Introduction of primary air into the combustion chamber is generally effected through openings in the top of the coke oven chamber. These ports are frequently so devised that they admit primary air vertically onto the coke cake without a further distribution into the gas-filled coke oven chamber. For a further admission of primary air, the coke oven walls, too, which are located above the coke oven doors can be equipped with openings for the admission of primary air. By applying this procedure, sufficient primary air is admitted into the chamber so that coking gas can be burnt to such an extent that sufficient heat develops in the gas space above the coking chamber.

An example of this ventilation technique is given in WO 2006128612 A1. The coking chamber of a coke oven has a plurality of entry ports in the top through which the coking gas developing during coal carbonization is evenly brought in contact with the desired quantity of primary air for partial combustion of coking gas. Above the oven, these entry ports for primary air can be grouped separately by way of an air admission system, and the air admission systems of the individual oven chambers are connected to an air admission system being common for many oven chambers. To modify the amount of primary air throughout the coking time, one control element each is provided between the air admission system and the air feeders of the individual oven chambers. A substantial homogenization in the distribution of primary air is achieved in this manner.

However, this technique has a disadvantage in that it requires a plurality of opening ports to achieve an even distribution of primary air. For this reason, it would be of some advantage if an even distribution of primary air in the gas space above the coke cake could be achieved with a substantially smaller number of opening ports for primary air. It is therefore the task to provide a supply system for primary combustion air that can work with a smaller number of opening ports in the top area and that nevertheless achieves an even distribution of primary combustion air.

BRIEF SUMMARY OF THE INVENTION

The present invention solves this task by providing a distribution system for primary combustion air which admits primary combustion air through opening ports in the top of a coke oven, and wherein these opening ports have a distribution system that introduces the inflowing primary air at a chamfered angle into the gas space above the coke cake. It is thereby possible to achieve a better distribution of primary air. A distribution of primary air in a chamfered angle can be effected both with one opening port and with several opening ports. The distribution of air into the gas space of a coke oven chamber can be effected in one, in several and in all lateral horizontal directions.

In one embodiment of the invention is a device for the supply of primary combustion air for the combustion of coking gas in a coking chamber of a coke oven of the "Non-Recovery" or "Heat-Recovery" type, wherein one or several entry ports for primary air are arranged in the top of each oven chamber above the oven separately for each oven chamber by way of a an air supply system in such a manner that the coking gas developing during combustion is conducted into a gas-filled space located above the coke cake wherein the coking gas is brought in contact with the primary air, and which is characterized in that this entry port or these entry ports have a gas-conduction device on the underside of the top, said gas-conduction device having an outflow angle directed outwardly to the opening which is greater than 0°, relative to a perpendicular plumb through the top.

The distribution of primary air in lateral directions can be effected both by gas-conducting devices located in the opening ports for primary air and by the opening ports themselves. In this case, the latter walls of the opening ports relative to a perpendicular plumb through the top have an outwardly directed angle which is greater than 0° and which is an opening angle. In a preferred embodiment of the present invention, the angle formed by the lateral walls of the opening ports relative to a perpendicular plumb through the top of the coke oven chamber is greater than 0° and smaller than 20°. The outwardly directed angle can be provided both directly with a permanent inclination and with a staggered arrangement.

The opening ports can be of any arbitrary shape. They can be covered on the top side in order to protect the opening port from weather impacts. The opening ports are advantageously configured as channels on the upper side of the oven top. These channels can also be closed to protect the coke oven interior from weather impacts. For example, this closure can be a simple cover, but it can also be a flap or a slide gate. The openings can also be configured as U-shaped tubes. To be able to improve control and regulation of the flow of primary air or to be able to intensify it, the tube can also be equipped with a blower 50.

The gas-conducting devices (or entry ports) can be of an arbitrary shape. They can be shaped as dishes or as a disk having several openings. In a preferred embodiment, the disk is round and has 2 to 6 openings. The disk can also be provided with sickle-shaped openings or with slots or notches in order to conduct air in a better way. However, the gas-conducting devices can also be of a turbine or star shape. The device for the supply of combustion air can be comprised of an ultra-high heat resistant steel, ceramics, silica or fireclay bricks or of a combination of these construction elements. In principle, however, they can be comprised of any arbitrary material that is suitable for the introduction of air into gas spaces of a high temperature.

The gas-conducting devices can be manufactured arbitrarily. For example, they can be worked-in directly into the coke oven top. It is possible, for instance, to manufacture a disk with special openings, entry ports or conducting elements and to insert these into the destined openings. For example, this can be realized with a ceramic adhesive, mortar or cement. The fastening is then carried-out so as to be resistant to temperatures. The openings can also be equipped with a blower upstream to or downstream of the gas-conducting device in order to improve the admission of primary air. The gas-conducting devices can also be held in place by splints, bolts or any other suitable holding device in the opening for the supply of primary air.

The gas-conducting devices can also be so configured that they are exchangeable so that they can be inserted or exchanged during an interruption of operation. A suitable configuration for this purpose is a disk with gas-conduction entry ports which can be inserted by means of splints or with a suitable mortar, depending on demand. To achieve a particularly efficient streaming-on, the gas-conducting devices are comprised of channels which have a length vs. diameter ratio greater than 0.8 and smaller than 10. In a particularly preferred embodiment, the gas-conducting devices are comprised of channels which have a length vs. diameter ratio greater than 3.

The gas-conducting devices can comprise twisting elements in order to give the inflowing primary air a twisting motion. The twisting elements, for example, can be made of a high-temperature resistant steel or be bricked-up. But these may also comprise elements that increase the gas velocity. For example, these elements may be Venturi elements or constraints by which the tangential velocity component of the inflowing primary air can be increased. A better intimate mixing of primary air with the coking gas in the gas space of the coking chamber may be achieved.

To improve the supply of primary air into the gas space above the coke cake, the coke oven chamber walls above the coke oven chamber doors or the coke oven doors themselves may also have openings for admission of primary air. An example for a coke oven chamber battery, the coke oven chambers of which have nozzle jet shaped openings in the coke oven chamber walls for an improved supply of primary air, is given by DE 1020 07042502. These openings, too, can be equipped with gas-conducting facilities. If the nozzle jets are linearly directed and not provided with gas-conducting facilities, then the air streams in parallel to the coke cake and can hardly distribute itself properly in the *gas space of the coke oven chamber. But if the opening in the coke oven chamber wall has a gas-conducting device which relative to a perpendicular plumb through the frontal closing coke oven wall above the coke oven door has an outwardly directed angle which is greater than 0°, then the coke cake is streamed-on not in parallel but in a directed way at an angle of greater than 0° and the primary air can thus distribute itself better in the gas space of the coke oven chamber. These devices can be exactly shaped like the gas-conducting devices in the coke oven top. Both the frontal, closing coke oven chamber wall above the coke oven chamber door and the coke oven chamber door itself may comprise these gas-conducting devices.

It is also possible to provide the openings above the coke oven chamber door as well as the openings in the coke oven chamber door itself with an outwardly directed opening angle which relative to a vertical plumb through the frontal closing coke oven wall above the coke oven door has an angle directed outwardly to the opening that is greater than 0°. Thereby the inflowing primary air streams to the coke cake not in parallel but in a directed way at an angle greater than 0°, thus allowing the primary air to distribute itself better in the gas space of the coke oven chamber. The coke oven chamber wall as well as the coke oven chamber door may comprise both one and several opening(s) which are provided with the inventive opening angle or with an inventive gas-conducting device.

According to another embodiment of the invention, a method is disclosed for the supply of combustion air for the combustion of coking gas into a coking chamber of a coke oven of the "Non-Recovery" or "Heat-Recovery" type, wherein the primary air streams through one or several entry ports in the top of each oven chamber above the oven, with the coking gas developing during combustion being conducted into a gas-filled space existing above the coke cake where the coking gas is brought into contact with the primary air, and which is characterized in that the primary air streams to the coke cake through devices conducting the gas stream at an angle of less than 90°.

The method for the supply of primary air into the gas space of a coking chamber can be applied with all conditions that are typically and especially suitable for the execution of coal carbonization. Typical conditions for the execution of coal carbonization are temperatures of 900° C. to 1550° C. To execute coal carbonization, any arbitrary feedstock materials, too, may be used. For example, hard coal can preferably be used, but it is also possible to use lignite, charcoal or biological materials.

The openings in the frontal closing coke oven wall, too, can be equipped with gas-conducting devices. In this case, the method also covers the supply of primary air through openings in the wall of a coke oven chamber above the coke oven chamber door with an improved an improved distribution of primary air.

The inventive device and the inventive method provide the benefit of an even distribution of primary air in the gas space of a coke oven battery. An inventive device can also be installed at low expenditure on existing primary air facilities and it is non-sensitive to high temperatures and chemical influences.

The inventive device is elucidated by way of seven drawings, these drawings just representing examples of embodiments for the design and construction of the inventive device.

DETAILED DESCRIPTION OF THE INVENTION

Figure 1:
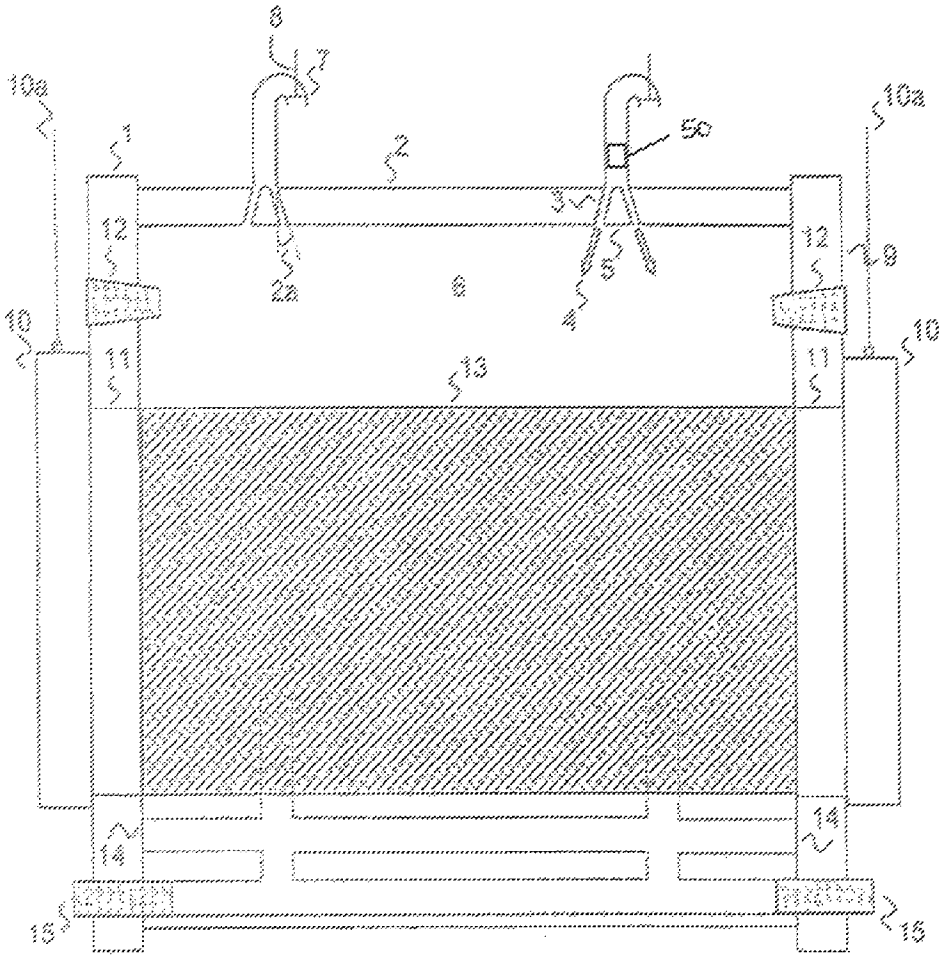
FIG. 1 shows a lateral view of an embodiment of a coke oven battery.

FIG. 1 shows a coke oven battery (1) in a lateral view. Located on the upper side of the coke oven battery is the coke oven top (2). Located in the coke oven top (2) are openings (3) with an inclined outflow angle (2*a*), through which primary air (4) streams into the coke oven. The openings have entry ports (5) through which the gas stream (4) is conducted laterally into the gas space (6) of the coke oven chamber. In one embodiment, the entry port (5) is a disk (30) as described in greater detail below. Due to the angle (2*a*) of the openings (3), the gas stream (4) exits in a generally lateral direction so that the gas stream (4) is better distributed in the gas space (6). On the upper side of the coke oven chamber, openings (3) are provided with U-tube-shaped covers (7) such that the openings (3) may be protected from weather impacts. The U-tubes (7) also comprise flaps (8) which may help to control and regulate the gas stream (4). Here, one can also see the lateral coke oven chamber wall (9) above the coke oven chamber door (10) with the opening lying there behind towards the coke oven chamber (11) and the moving mechanism for the coke oven chamber door (10*a*). The coke oven chamber wall (9) may also comprise openings (12) for introduction of primary air (4) into the gas space (6) of the coking chamber (11). These conduct primary air (4) into the gas space (6) above the coke cake (13). Here one can also see asecondary air sole (14) and respective openings (15) for controlling and regulating a secondary air stream.

Figure 2:
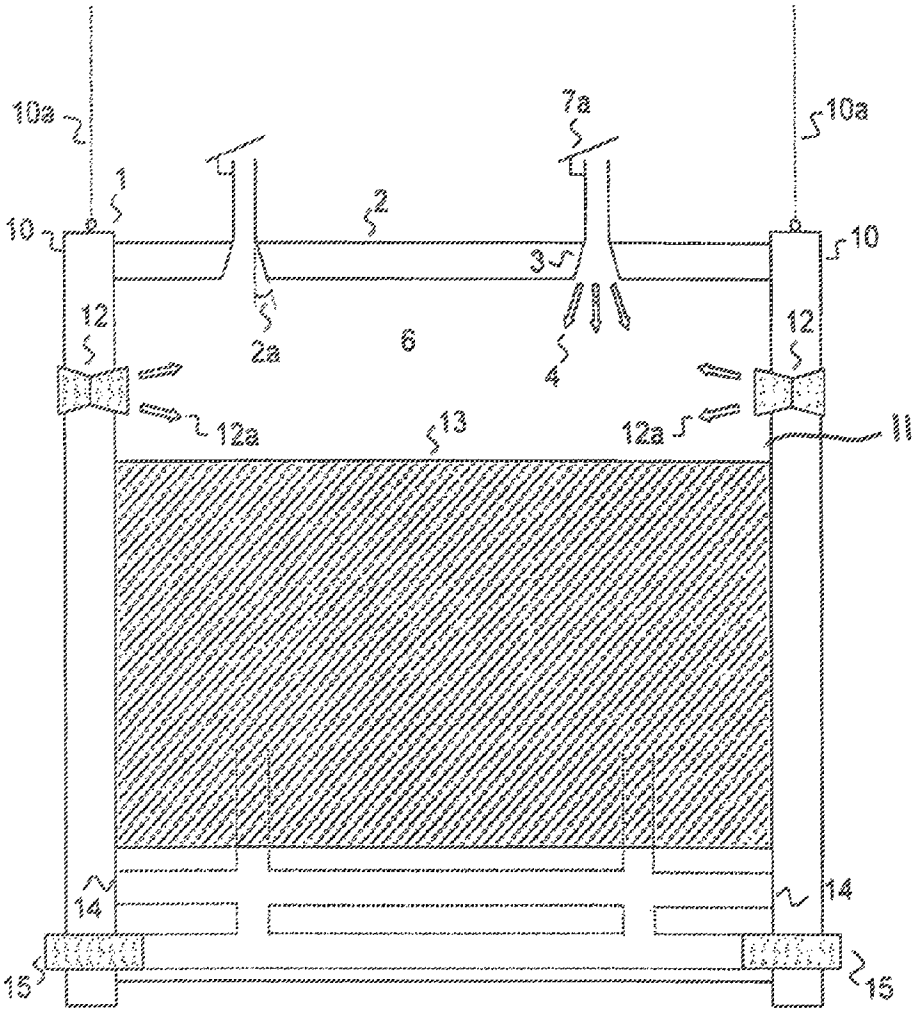
FIG. 2 shows an additional lateral view of an embodiment of a coke oven battery.

FIG. 2 shows a coke oven battery (1) in a lateral view. Located on the upper side of the coke oven battery is the coke oven top (2). Located in the coke oven top (2) are openings (3) with an inclined opening angle (2*a*) through which the primary air (4) streams into the coke oven (1). The openings (3) have chamfers which serve as gas-conducting devices and which deflect the primary air stream (4) in lateral direction. Thereby the primary air (4) is better distributed Channels (7*a*) may be provided atop the openings (3) on the upper side of the coke oven chamber (11), and may include flaps to help protect the openings (3) from weather impacts. Here one can also see the lateral coke oven chamber wall, which in this case is configured as a coke oven chamber door (10). The coke oven chamber door (10) also comprises openings (12) for the introduction of primary air (4) into the gas space (6) of the coke oven chamber (11). These openings (12) may conduct primary air (4) into the gas space (6) above the coke cake (13). The openings (12) comprise an outwardly directed opening angle so that the primary air (4) is streamed into the coke oven chamber (11) not in parallel, but in a directed way (12*a*) (e.g., as illustrated by FIG. 2). Also to be seen here is a secondary air sole (14) and respective openings for controlling and regulating a secondary air stream (15).

Figure 3:
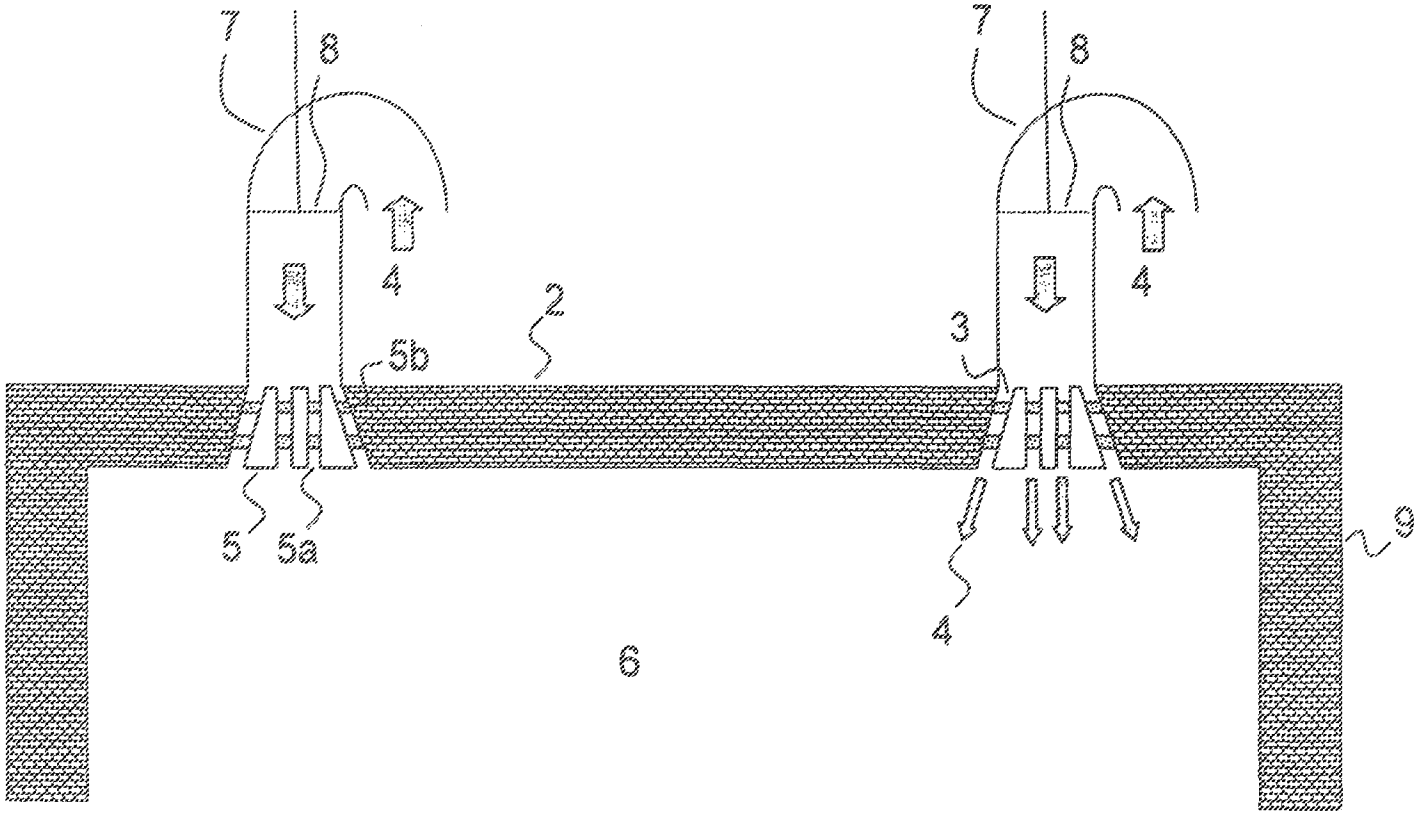
FIG. 3 shows a top view of an embodiment of a coke oven chamber.

FIG. 3 shows the top of a coke oven chamber (2) with openings (3) through which primary air (4) streams into the coke oven. These openings (3), too, are provided with entry ports (5) having openings (5*a*) therein for directing the primary air stream (4) into the gas space (6) above the coke oven chamber (11). Thereby, the primary air streams (4) are laterally directed (4) into the gas space (6) of the coke oven chamber (11). Here, too, the openings (3) are covered by U-tubes (7) which protect the openings (3) from weather impacts. The U-tubes (7) here comprise flaps (8) through which the primary air stream (4) can be controlled or shut-off. The coke oven top (2) and the coke oven chamber wall (9) may be comprised of a bricked-up wall, for example. Mounted at the coke oven wall (9) are splints (5*b*) which retain the entry ports (5) in the openings (3).

Figure 4:
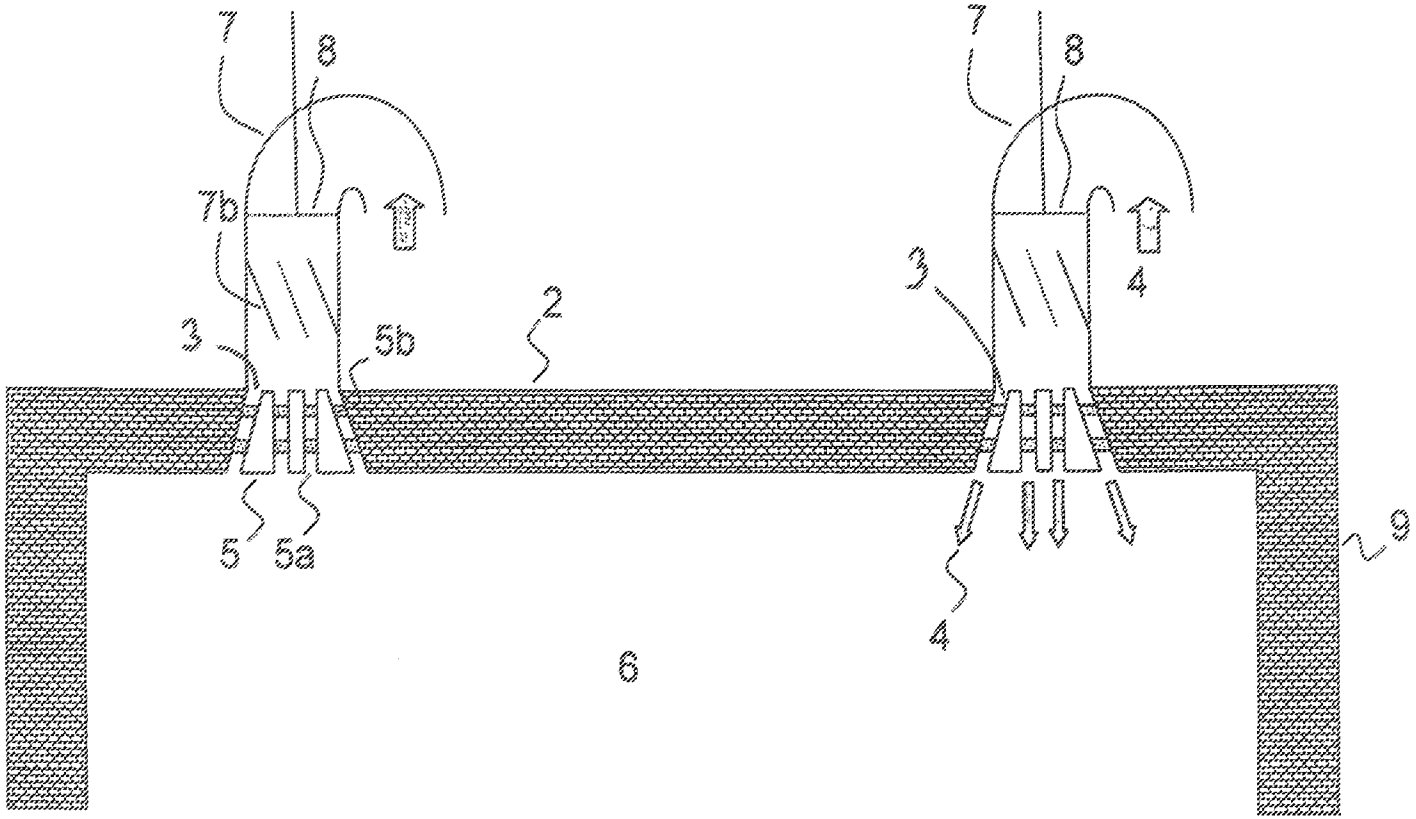
FIG. 4 shows another top view of an embodiment of a coke oven chamber.

FIG. 4 also shows a top of a coke oven chamber (2) with openings through which primary air (4*a*) streams into the coke oven (11). These openings (3), too, comprise entry ports (5) which direct the primary air stream (4) into the coke oven (11) via openings (5*a*), which may take the form of channels, as described below regarding FIG. 6. The U-tube-shaped openings (7) in their interior are provided with twisting elements (7*b*). By means of these twisting elements (7*b*) the inflowing primary air (4) is given a twisting motion so that it can distribute itself better in the gas space (6) of the coke oven chamber (11). Also shown here are the splints (5*b*).

Figure 5:
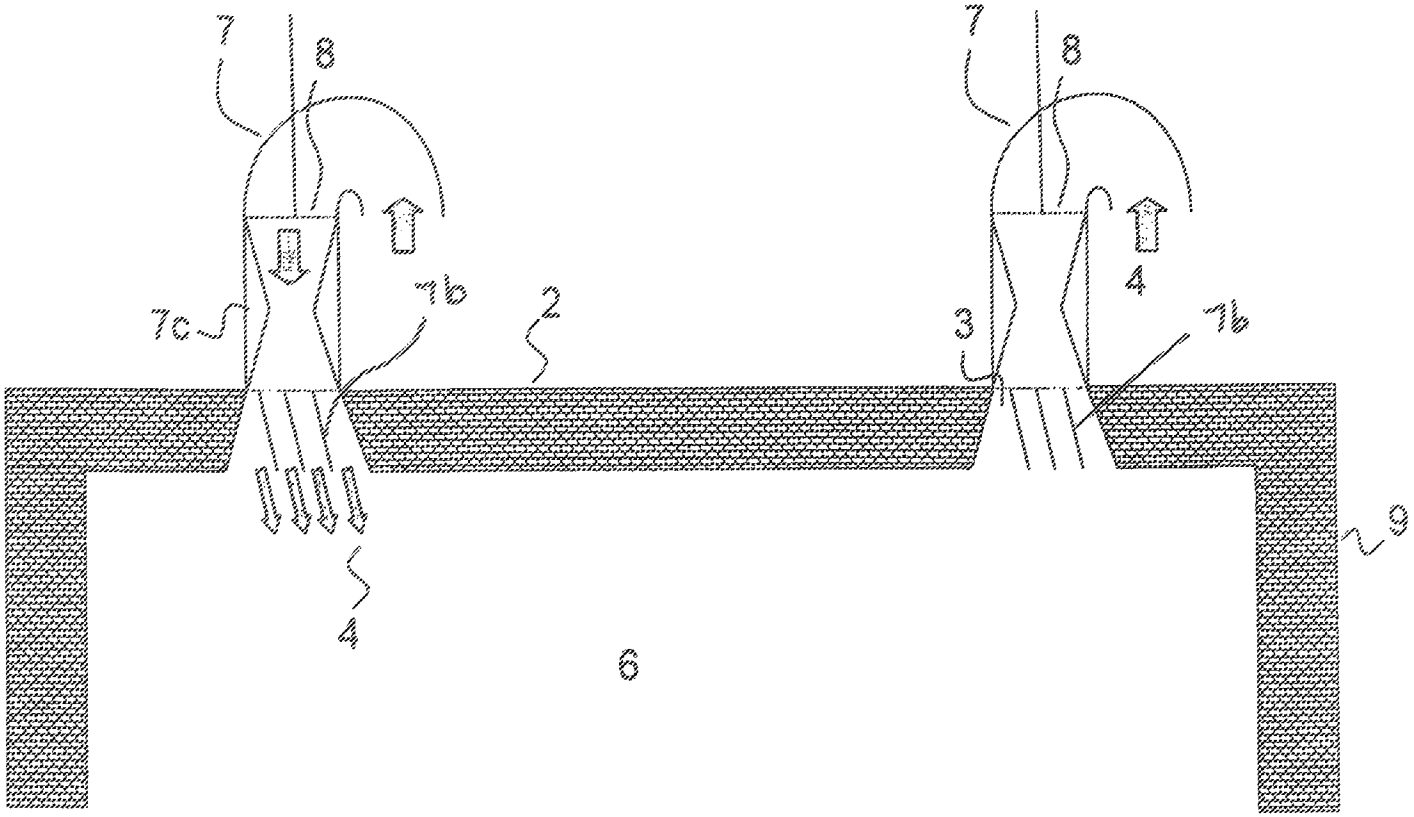
FIG. 5 shows another top view of an embodiment of a coke oven chamber.

FIG. 5 also shows the top of a coke oven chamber (2) with openings (3) through which the primary air (4) streams into the coke oven (11). The U-tube-shaped covers (7) in their interior comprise Venturi elements (7*c*) by which the tangential velocity of inflowing air (4) can be increased. Instead of entry ports (5), the opening (3) has twisting elements (7*b*) which are firmly connected to the brickwork and which give the inflowing air (4) a twisting motion. Thereby it distributes itself better in the gas space (6) of the coke oven chamber (11).

Figure 6:
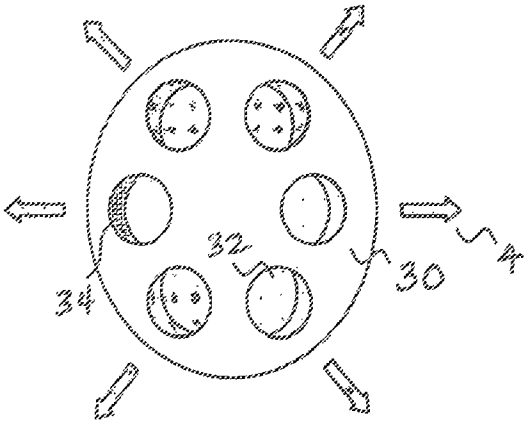
FIG. 6 shows a disc used as an opening in a coke oven top.

As noted above, the entry port (5) may take the form of a disk having apertures for allowing air to pass through. FIG. 6 shows a disk (30) configured as an entry port (5) and which is inserted into the opening (3) of the coke oven top (2). It is embedded in the opening (3) that admits primary air (4) to stream into the coke oven (11). The disk (30) may be vaulted or planar. In a typical embodiment, the disk (30) has the thickness of the coke oven top (2) and fits properly into the opening (3). This disk (30) may be made of ceramics, silica or a fireclay brick. It is embedded with a ceramic mortar or bonding agent into the opening. The disk (30) here is provided with six round openings (32) which are laterally directed towards the outside. The apertures (32) may take the form of channels, as shown. Piping (34) extends through the interior of the disk (30). Through these apertures (32), primary air (4) streams into the gas space (6) of the coke oven chamber (11) during the operation of the coke oven (1). Owing to the directed shape of the apertures (32), the primary air (4) streams laterally in outward direction.

Figure 7:
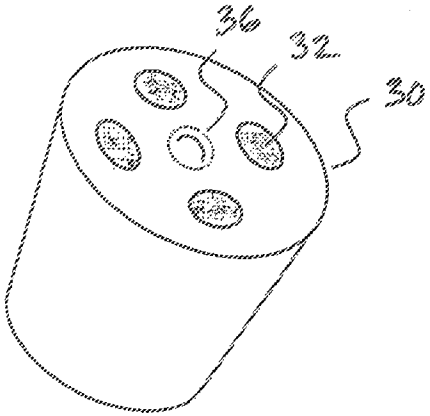
FIG. 7 shows a lateral view of an embodiment of a disc.

FIG. 7 shows the disk (30) in a lateral view. The disk (30) here is shown in its entire thickness. Also shown here is a hook (36) for removing the disk (30) from the coke oven top (2).

Figure 8:
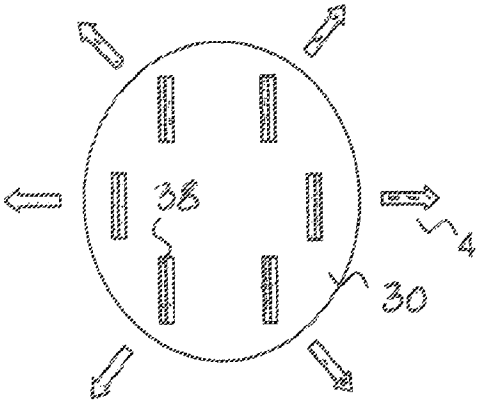
FIG. 8 shows an alternative embodiment of a disc.

FIG. 8 shows the same disk (30), but instead of round openings, the disk (30) is provided with slots (38) for the conduction of primary air (4).

Figure 9:
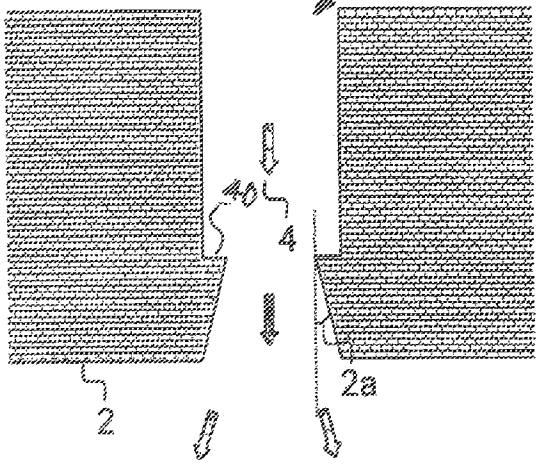
FIG. 9 shows another top view of an embodiment of a coke oven chamber.

FIG. 9 shows the top (2) of a coke oven chamber, with an opening (3) for primary air (4) being guided through it. At the exit to the coke oven chamber (1), this opening (3) is angled (2*a*) such that the gas (4) streams-out from the opening (3) laterally into the gas space (6) of the coke oven chamber (1). The angle (2*a*), which is greater than 0°, develops underneath a contraction (40) in the opening (3) and is relative to a vertical plumb through the top of the opening (e).

Figure 10:
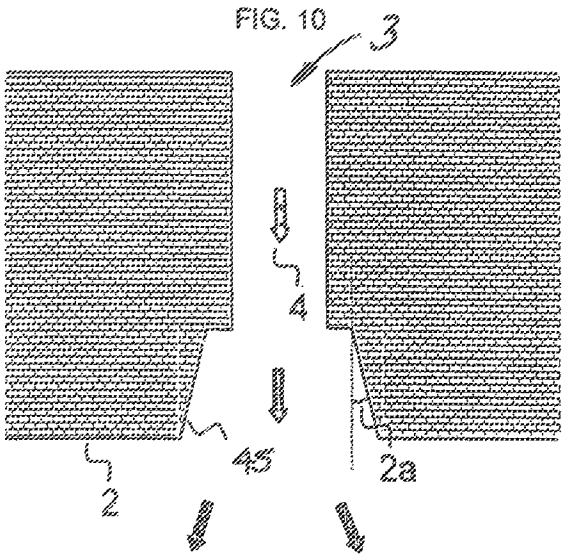
FIG. 10 shows another top view of an embodiment of a coke oven chamber.

FIG. 10 shows the top (2) of a coke oven chamber (1), with an opening (3) for primary air (4) to be guided through it. At the exit to the coke oven chamber (1), this opening (3) has an angle (2*a*) which conducts the gas streaming-out from the opening (3) laterally into the gas space (6) of the coke oven chamber (1). The angle (2*a*), which is greater than 0°, is determined between a widening (45) in the opening (3) and a vertical plumb through the top of the opening (3).

Figure 11:
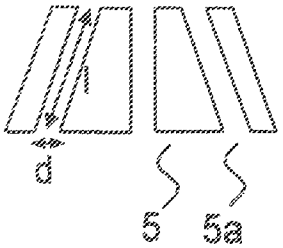
FIG. 11 shows an entry port for an embodiment of a coke oven chamber.

FIG. 11 illustrates an entry port (5) with openings (5*a*), which may actually take the form of channels, having a length, l, and a diameter, d. The ratio between length and diameter is advantageously greater than 0.8 and smaller than 10. The length vs. diameter ratio advantageously is greater than 3.

The invention claimed is:

1. A device for the supply of primary combustion air for the combustion of coking gas into a coking chamber of a coke oven of the "Non-Recovery" or "Heat-Recovery" type, comprising:

a coke oven comprising an oven chamber;

an opening in the top of the coke oven chamber;

an air supply system comprising an entry port for the introduction of primary air, the entry port being arranged in the opening in the top of the oven chamber in such a manner that coking gas developed during coking and conducted into a gas-filled space located above the coke cake is brought into contact with the primary air for combustion;

wherein said entry port comprises channels formed therein, said channels having an outflow angle directed outwardly to the opening which is greater than 0°, relative to a perpendicular plumb through the top.

2. The device as defined in claim 1, wherein the openings located in the top have a U-tube-shaped cover on the upper side of the top.

3. The device as defined in claim 2, wherein the U-tube-shaped cover comprises a flap or a device that can control and regulate the incoming stream of primary air.

4. The device as defined in claim 2, further comprising twisting elements or Venturi elements located within the cover for widening the gas stream or increasing the tangential gas velocity component.

5. The device as defined in claim 1, wherein at least one entry port having channels formed therein is located in the frontal closing coke oven wall above the coke oven door or in the coke oven door, the channels having an outflow angle directed outwardly to the opening which is greater than 0°, relative to a perpendicular plumb through the frontal closing coke oven wall above the coke oven door.

6. The device as defined in claim 1, wherein apertures are located in the frontal closing coke oven wall above the coke oven door or in the coke oven door, at least one aperture having an outflow angle directed outwardly to the opening which is greater than 0°, relative to a perpendicular plumb through the frontal closing coke oven wall above the coke oven door.

7. The device as defined in claim 1, wherein the channels have a length vs. diameter ratio greater than 0.8 and smaller than 10.

8. The device as defined in claim 1, wherein the channels have a length vs. diameter ratio greater than 3.

9. The device as defined in claim 1, wherein the device for the supply of combustion air is comprised of an ultra-high heat resistant steel, ceramics or silica or fireclay bricks or of a combination of these construction elements.

10. A method for the supply of combustion air for the combustion of coking gas into a coking chamber of a coke oven of the "Non-Recovery" or "Heat-Recovery" type, comprising:

streaming primary air through an entry port positioned in an opening in the top of each oven chamber above the oven such that the coking gas developed during coking is conducted into a gas-filled space existing above the coke cake and brought into contact with the primary air for combustion, wherein:

said entry port having channels formed therein, said channels having an outflow angle directed outwardly to the opening which is greater than 0°, relative to a perpendicular plumb through the top.

* * * * *